United States Patent [19]

Louzon

[11] 4,406,712

[45] Sep. 27, 1983

[54] CU-NI-SN ALLOY PROCESSING

[75] Inventor: Theodore J. Louzon, Bridgewater, N.J.

[73] Assignee: Bell Telephone Laboratories, Incorporated, Murray Hill, N.J.

[21] Appl. No.: 291,070

[22] Filed: Aug. 7, 1981

Related U.S. Application Data

[63] Continuation-in-part of Ser. No. 133,617, Mar. 24, 1980, abandoned.

[51] Int. Cl.[3] ..... C22F 1/08

[52] U.S. Cl. ..... 148/11.5 C; 148/12.7 C; 148/160

[58] Field of Search ..... 48/11.5 C, 12.7 C, 160; 75/154, 159

[56] References Cited

U.S. PATENT DOCUMENTS

| | | | |
|---|---|---|---|
| 3,937,638 | 2/1976 | Plewes | 148/12.7 |
| 3,941,620 | 3/1976 | Pryor et al. | 148/12.7 |
| 4,012,240 | 3/1977 | Hinrichsen et al. | 148/11.5 |
| 4,046,596 | 9/1977 | Metcalfe et al. | 148/2 |
| 4,052,204 | 10/1977 | Plewes | 75/154 |
| 4,090,890 | 5/1978 | Plewes | 148/12.7 |
| 4,130,421 | 12/1978 | Plewes | 75/154 |
| 4,142,918 | 3/1979 | Plewes | 148/11.5 |

OTHER PUBLICATIONS

E. M. Wise et al., "Strength and Aging Characteristics of the Nickel Bronzes", Trans. AIME, Institute of Metals Division, vol. 3, pp. 218–243, (1943).

T. E. Kihlgren, "Production and Properties of Age Hardenable Five Percent Nickel-Bronze Castings", Trans. AFA, vol. 46, pp. 41–64, (1938).

L. H. Schwartz et al., "Spinodal Decomposition in a Cu-9 Weight Percent Ni-6 Weight Percent Sn Alloy", Acta Metallurgica, vol. 22, May 1974, pp. 601–609.

J. T. Eash, "Constitution of Copper-Nickel-Tin Alloys", Metals Handbook, American Society for Metals, 1939.

*Primary Examiner*—Peter K. Skiff

*Attorney, Agent, or Firm*—Peter A. Businger

[57] ABSTRACT

Alloys comprising copper, nickel and tin, when appropriately processed, exhibit high levels of tensile strength and ductility. Processing has been by cold working and aging or, when cold working is impracticable, by aging of alloys which are modified by the addition of a refractory element.

It has been discovered that, even without cold working and even in the absence of additives, strong and ductile Cu-Ni-Sn alloys can be produced when a body of the alloy is subjected to a characteristic heat treatment to develop an alpha plus essentially nonlamellar gamma structure. This is followed by cooling and aging at a temperature and for a time corresponding to a predominantly spinodal alpha-1 plus alpha-2 structure.

Typical properties are a 0.01 percent offset yield strength of 128 Kpsi and an elongation to fracture of 5 percent in an alloy comprising 15 weight percent Ni, 8 weight percent Sn, and remainder essentially Cu.

16 Claims, 8 Drawing Figures

5 WT % Ni

10 WT % Ni

15 WT % Ni

CU-NI-SN ALLOY PROCESSING

CROSS REFERENCE TO RELATED APPLICATIONS

This is a continuation-in-part of patent application Ser. No. 133,617, filed Mar. 24, 1980, abandoned.

TECHNICAL FIELD

The invention is concerned with copper based alloys.

BACKGROUND OF THE INVENTION

Copper based alloys comprising Ni and Sn have received considerable attention in connection with the manufacture of articles which may be shaped as cast, hot worked, cold worked, or machined. An early line of development is represented by papers by E. M. Wise et al., "Strength and Aging Characteristics of the Nickle Bronzes", *Trans. AIME, Institute of Metals Divsion,* Vol. 3, pp. 218–243 (1934) and by T. E. Kihlgren, "Production and Properties of Age Hardenable Five Percent Nickel-Bronze Castings", *Trans. AFA,* Vol. 46, pp. 41–64 (1938) which disclose Cu-Ni-Sn alloys which are strong and hard and which are suitable for certain casting applications. Equilibrium phase diagrams of Cu-Ni-Sn alloys are shown by J. T. Eash, "Constitution of Copper-Nickel-Tin Alloys", *Metals Handbook, America Society for Metals,* 1939, pp. 1371–1373.

More Recently, Cu-Ni-Sn alloys have been investigated and developed which are strong yet ductile and which are suitable, e.g., in the manufacture of wire, wire connectors, and springs. In particular, U.S. Pat. No. 3,937,638, issued to J. T. Plewes on Feb. 10, 1976, discloses articles which are processed by homogenizing, cold working, and aging. High levels of strength and ductility are ascribed to an alloy having a spinodally decomposed structure in which decompositon products, customarily designated as alpha-1 and alpha-2, are dispersed on a submicroscipically fine scale, as discussed in the paper by L. H. Schwartz et al., "Spinodal Decomposition in a Cu-9 weight percent Ni-6 weight percent Sn alloy", *Acta Metallurgica,* Vol. 22, May 1974, pp. 601–609.

U.S. Pat. No. 4,052,204, issued to J. T. Plewes on Oct. 4, 1977, discloses copper based spinodal alloys having compositions which are processed in a fashion similar to that disclosed in above-cited U.S. Pat. No. 3,937,638, but which, in addition to Cu, Ni, and Sn, contain fourth elements such as Fe, Zn, Mn, Zr, Nb, Cr, Al, or Mg in amounts within specified limits. U.S. Pat. No. 4,090,890, issued to J. T. Plewes on May 23, 1978, discloses copper based spinodal alloys which have compositions similar to compositions of alloys disclosed in above-cited U.S. Pat. No. 3,937,638 and 4,052,204, but which are cold worked by more limited amounts of rolling so as to achieve essentially isotropic formability in the rolled product. Resulting strip material is particularly suited for applications which require sharp bending as, e.g., in the manufacture of clips and electrical connectors.

Among further aspects of Cu-Ni-Sn alloys and their processing are a warm working treatment as disclosed in U.S. Pat. No. 4,012,240, issued to R. A. Hinrichsen et al. on Mar. 15, 1977; grain refinement as disclosed in U.S. Pat. No. 4,142,918, issued to J. T. Plewes on Mar. 6, 1979; and free machining as disclosed in U.S. Pat. No. 4,130,421, issued to J. T. Plewes et al. on Dec. 19, 1978. Also relevant in this context is a method for developing mechanical properties in certain quaternary Cu-Ni-Sn alloys which involves little or no cold working as disclosed by J. T. Plewes in patent application Ser. No. 6,616, filed Jan. 10, 1979, U.S. Pat. No. 4,260,432.

According to references cited above, development of a preferred spinodal structure and concomitant high levels of strength and ductility in Cu-Ni-Sn alloys is effected by processing involving cold working or by the addition of refractory elements or iron. The latter approach is effective even in the absence of cold work and has been preferred where articles are shaped as cast or where shaping is at elevated temperatures as, e.g., when shaping is by forging or extruding. Fabrication of alloys comprising refractory components may, however, require special care, e.g., in the preparation of a melt. Consequently, means are desired for producing shaped articles of Cu-Ni-Sn spinodal alloys without required cold working and without required refractory additives.

Also considered were U.S. Pat. No. 3,941,620, issued to M. J. Pryor et al. on Mar. 2, 1976 and U.S. Pat. No. 4,046,596, issued to R. T. Metcalfe et al. on Sept. 6, 1977. These patents disclose Cu-Ni-Sn alloys prepared by methods which rely on solution heat treatment at a temperature corresponding to a single phase state prior to rapid cooling, cold working, and aging.

SUMMARY OF THE INVENTION

Desirable properties such as, in particular, high ductility and tensile strength are developed in Cu-Ni-Sn alloys, without required cold working or fourth element addition, by a treatment comprising heating to develop an alpha plus essentially nonlamellar gamma structure. Alloys may be ternary or may optionally contain additional elements such as, e.g., refractory elements or Fe; processing further comprises rapid cooling and aging and may optionally comprise cold working. Exemplary properties are at 0.01 percent offset yield strength of 128 Kpsi and an elongation to fracture of 5 percent in an alloy containing 15 weight percent Ni, 8 weight percent Sn, and remainder essentially Cu.

DETALED DESCRIPTION

Figure 1:
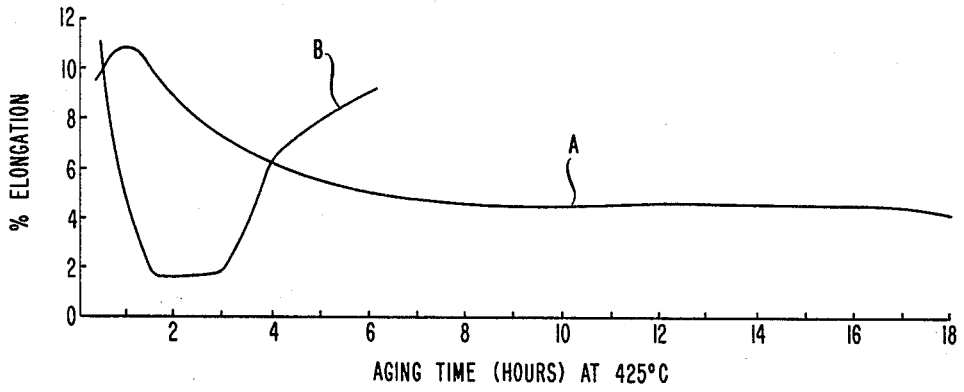
FIG. 1 graphically depicts percent elongation to fracture as a function of aging time for two ternary Cu-Ni-Sn samples having the same composition, one sample having been treated according to the invention.

Processing according to the invention is applied to Cu-Ni-Sn alloys in which a predominantly spinodal microstructure can be developed. Such microstructure is understood to be a decomposed structure in which decomposition products, customarily designated as alpha-1 and alpha-2, are interspersed on a submicroscopically fine scale. These alloys preferably comprise an amount of at least 80 weight percent Cu, Ni, and Sn in combination. Of such amount, Ni content is in a preferred range of 3–30 weight percent, and Sn content in a preferred range of 2.5–15 weight percent of the alloy. In the interest of the development of an adequate spinodal structure upon aging, Sn content of an alloy is preferably at least 3.5 weight percent.

For the sake of simplicity and ease of processing, alloys may be ternary or, for the sake of further enhancement of properties, alloys may contain additional elements such as, e.g., Nb, Mo, Ta, V, or Fe. Refractory metal additives Nb, Mo, Ta, and V are considered beneficial in limited amounts and, in particular, in amounts preferably not exceeding 1 weight percent individually and 2 weight percent in combination. Fe may serve as an inexpensive additive in amounts preferably not exceeding 15 weight percent. Similarly, amounts of Zn preferably not exceeding 10 weight percent or Mn in amounts preferably not exceeding 15 weight percent are considered tolerable. Among free machining additives, MnS is particularly effective in preferred amounts of up to 2 weight percent; free machining additives Se, Te, and Pb may be tolerated in preferred amounts not exceeding 0.5 weight percent Se, 0.5 weight percent Te, and 0.2 weight percent Pb. Elements Zr, Cr, Al, and Mg tend to embrittle the alloy and are preferably kept within preferred limits of 0.2 weight percent Zr, 1 weight percent Cr, 1.5 weight percent Al, and 1 weight percent Mg.

Processing is initiated by producing a sufficiently homogeneous body of an alloy having a composition as described above. This may be effected e.g., by melting of alloy constituents, casting, annealing, and quenching at a rate sufficient to achieve a desired grain structure. Cast shape may be a desired shape of an article of manufacture; alternatively, desired shape may be obtained at this point by hot working, warm working, or cold working.

According to the invention, a body is subjected to a thermal treatment whose steps may be designated as heating to develop an alpha plus essentially nonlamellar gamma structure, cooling, and aging. After cooling and prior to aging, a step of cold working may optionally be carried out, e.g., for shaping into desired form.

Heating to develop alpha plus essentially nonlamellar gamma structure is at temperatures corresponding to a multiphase, predominantly alpha plus gamma phase in the temperature-time-transformation diagram, gamma phase being more specifically of a type which may be contrasted with a lamellar type which may also be designated as discontinuous. Lamellar structure has been observed to predominantly comprise gamma phase whose morphology is that of platelets; this is contrasted with an observed predominantly spheroidal morphology of gamma particles when structure is nonlamellar. The latter, desired type corresponds to temperatures in an interval whose preferred upper limit, here designated $T_2$, is at the boundary between a single phase alpha state and a two-phase alpha plus gamma state in the phase diagram of an alloy. The preferred lower limit, here designated $T_1$, corresponds to a transition between lamellar and nonlamellar structure of gamma phase and may be determined by standard metallurgical analytical techniques such as, e.g., dilatometry, resistivity measurement, or metallographic analysis.

Preferred amounts of nonlamellar gamma phase produced upon heating are at least 0.1 weight percent of the alloy; such amounts are desirable in the interest of enhancing spinodal decomposition upon aging and further in the interest of minimizing grain growth. Preferred grain size is less than or equal to 20 micrometers and preferably less than or equal to 5 micrometers.

For alloys containing Cu, Ni, and Sn within ranges as specified above, the desired temperature range extends typically from an approximate lower limit of 600 degrees Celsius to an approximate upper limit of 775 degrees Celsius. More precise lower limits on the desired temperature depend on Ni content of an alloy as follows: 575 degrees Celsius at 5 weight percent Ni, 600 degrees Celsius at 10 weight percent Ni, and 625 degrees Celsius at 15 weight percent Ni. Similarly, more precise preferred upper limits on the desired temperature depend on Ni content as follows: 750 degrees Celsius at 5 weight percent Ni, 775 degrees Celsius at 10 weight percent Ni, and 800 degrees Celsius at 15 weight percent Ni. More precise preferred lower and upper limits at other amounts of Ni in the preferred range of from 3 to 30 weight percent of the alloy may be obtained linearly scaled as a function of weight percent Ni in accordance with the respective formulas $5n+550$ and $5n+725$ degrees Celsius, where n denotes weight percent Ni.

Figure 6:
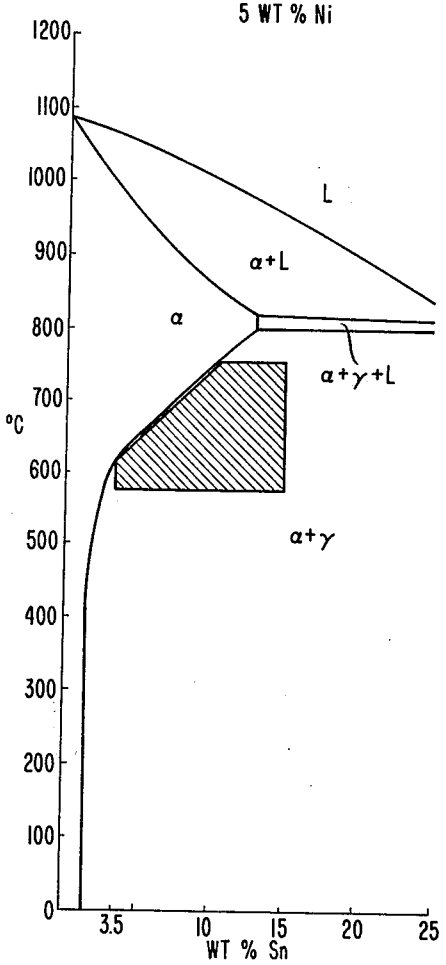
FIG. 6 is an equilibrium phase diagram of Cu-Ni-Sn alloys containing 5 weight percent Ni.
Figure 7:
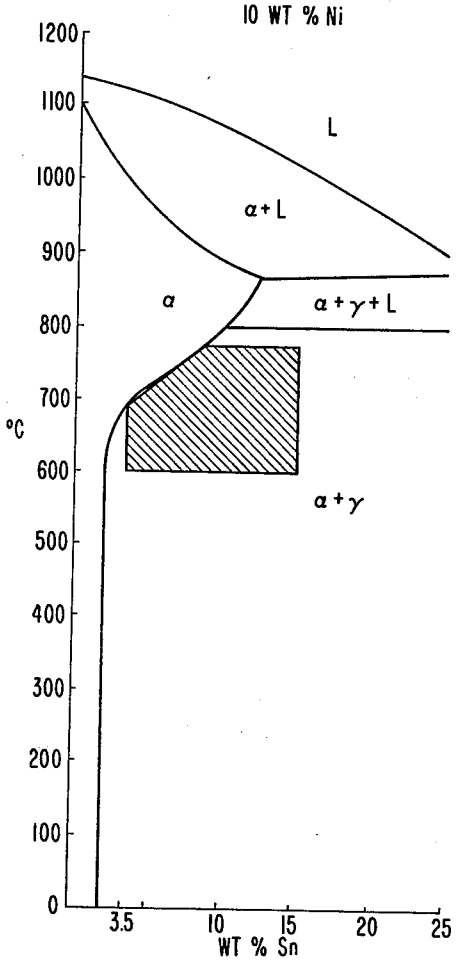
FIG. 7 is an equilibrium phase diagram of Cu-Ni-Sn alloys containing 10 weight percent Ni.
Figure 8:
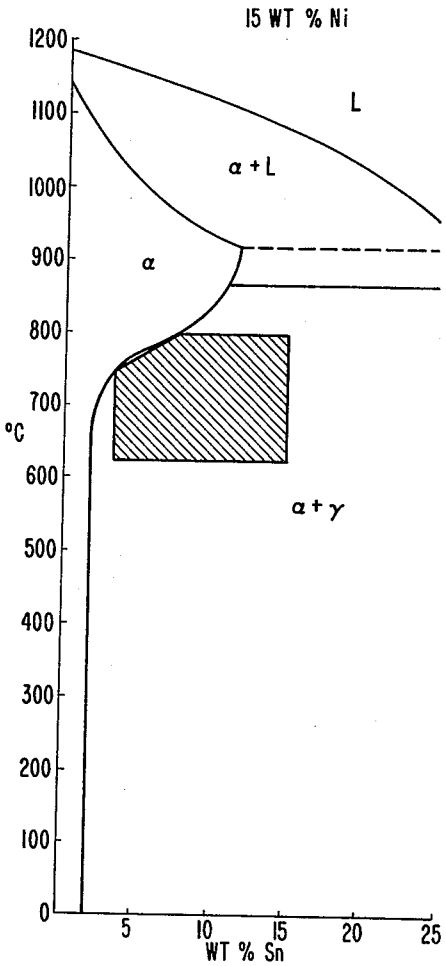
FIG. 8 is an equilibrium phase diagram of Cu-Ni-Sn alloys containing 15 weight percent Ni.

Further in the interest of heating at a temperature corresponding to a multiphase state in accordance with the invention, the desired temperature is subject to an upper limit which depends on Ni as well as on Sn contents of an alloy. Specifically, with n still denoting weight percent Ni in the alloy, and with s denoting weight percent Sn, preferred temperatures are less than $17(n+s)+465$ degrees Celsius and preferably less than or equal to $17(n+s)+460$ degrees Celsius. Such upper limits are justified empirically and are based on equilibrium phase diagrams shown in FIGS. 6–8. The diagrams geometrically illustrate, by means of shaded areas, preferred temperatures within stated limits.

Heating to develop alpha plus essentially nonlamellar gamma structure may be effected by simple soaking at approximately constant temperature; alternatively, an alloy may be worked at a desired temperature.

After heating to develop an alpha plus essentially nonlamellar gamma structure, the alloy is cooled rapidly as, e.g., by water quenching or air cooling, cooling rate being chosen sufficiently high to assure retention of a substantial amount of structure of gamma particles in alpha. Cooling is to a temperature corresponding to an alpha-1 plus alpha-2 phase in the time-temperature-transformation diagram and may, e.g., be to room temperature or below. Alternatively, cooling may be to a temperature which is higher than room temperature but sufficiently low to prevent formation of appreciable amounts of alpha plus lamellar gamma phase. After cooling, a preferred amount of at least 90 weight percent and preferably at least 99 weight percent of gama phase is nonlamellar. Cold working after cooling is optional.

After cooling, a step of aging is called for during which strength is developed while a substantial amount of ductility is retained. Such aging is at temperatures and for times corresponding to the development of spinodal alpha-1 plus alpha-2 structure, care being indicated to prevent excessive development of an alpha plus lamellar gamma structure. In this respect, a temperature of 500 degrees Celsius represents a preferred over-all approximate upper limit on aging temperature for alloys whose composition is within limits as specified above. Aging time depends on composition and size of a work piece, larger pieces typically requiring longer aging time. Aging times in a range of 1–8 hours are typical.

Figure 2:
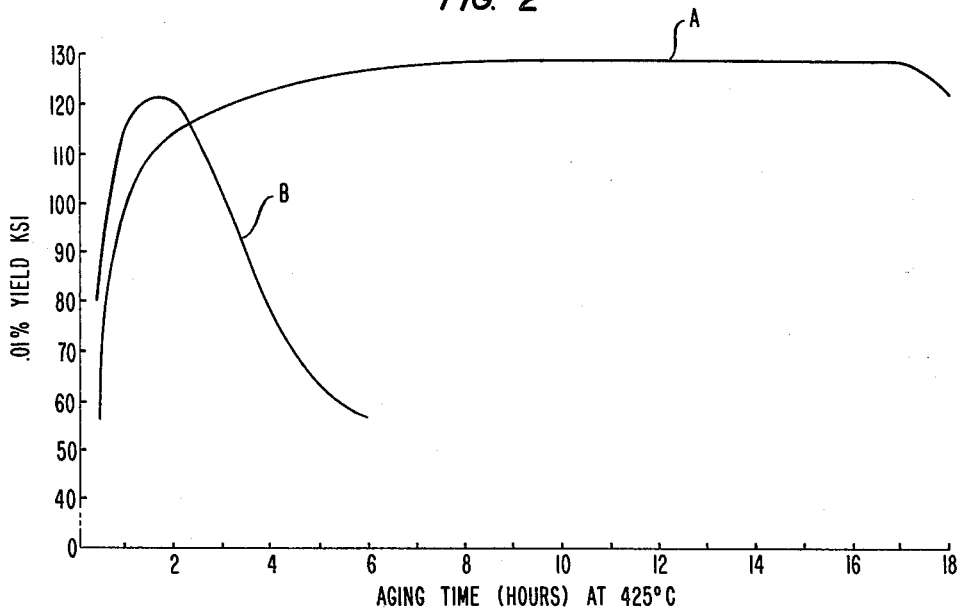
FIG. 2 graphically depicts 0.01 percent offset yield strength as a function of aging time for samples as described above.

Properties realized by aging were found to be relatively insensitive to prolonged aging beyond one hour and up to 17 hours. This may be appreciated by reference to FIGS. 1–4 which show mechanical properties of elongation to failure and 0.01 percent offset yield strength as a function of aging time. Specifically, FIG. 1 shows percent elongation to failure realized in essentially ternary Cu-Ni-Sn samples comprising 15 weight percent Ni and 8 weight percent Sn. Curve A corresponds to a sample treated, according to the invention by heating to develop alpha plus essentially nonlamellar gamma structure at a temperature of 725 degrees Celsius for 1 hour, water quenching, and aging at a temperature of 425 degrees Celsius for times shown on the abscissa. Curve B corresponds to a sample which has the same composition, but which was treated by a preliminary heat treatment at 825 degrees Celsius corresponding to a single phase state. FIG. 2 similarly shows 0.01 percent offset yield strength for ternary alloy samples as described with respect to FIG. 1. It can be seen from curves A as contrasted with curves B that for aging times greater than approximately 1 hour, alloys treated according to the invention exhibit superior levels of strength and ductility.

Figure 3:
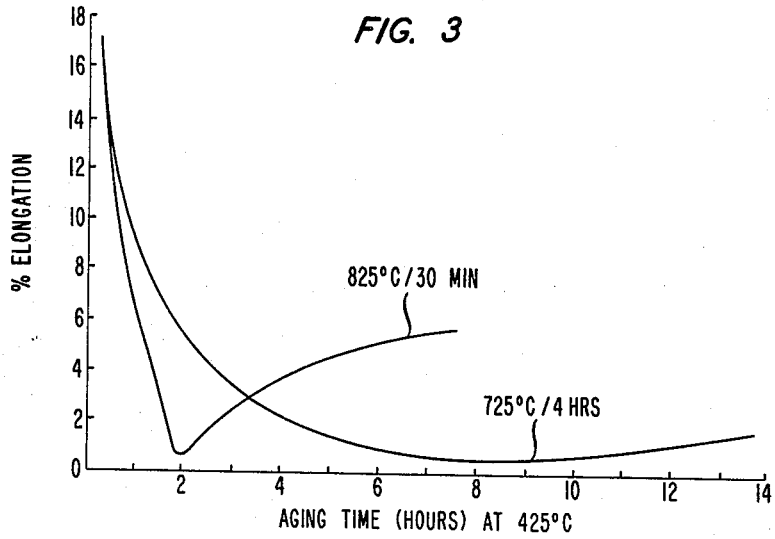
FIG. 3 graphically depicts percent elongation to fracture as a function of aging time for two quaternary Cu-Ni-Sn samples having the same composition, one sample having been processed according to the invention.
Figure 4:
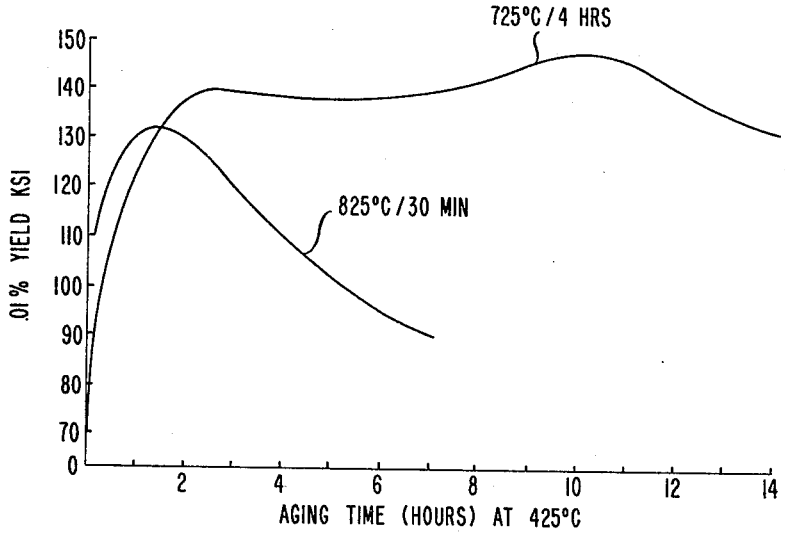
FIG. 4 graphically depicts 0.01 percent offset yield strength as a function of aging time in correspondence with FIG. 3.

FIGS. 3 and 4 show, respectively, percent elongation to failure and 0.01 percent offset yield strength of quaternary Cu-Ni-Sn samples comprising 15 weight percent Ni, 8 weight percent Sn, and 0.3 weight percent Nb. Preliminary heat treatments are as indicated at 725 degrees Celsius for 4 hours and at 825 degrees Celsius for 30 minutes respectively. It can be seen from FIGS. 3 and 4 that quaternary alloy samples which have been subjected to heating to develop alpha plus essentially nonlamellar gamma structure at 725 degrees Celsius have superior properties as compared with samples which have been heat treated at 825 degrees Celsius.

Figure 5:
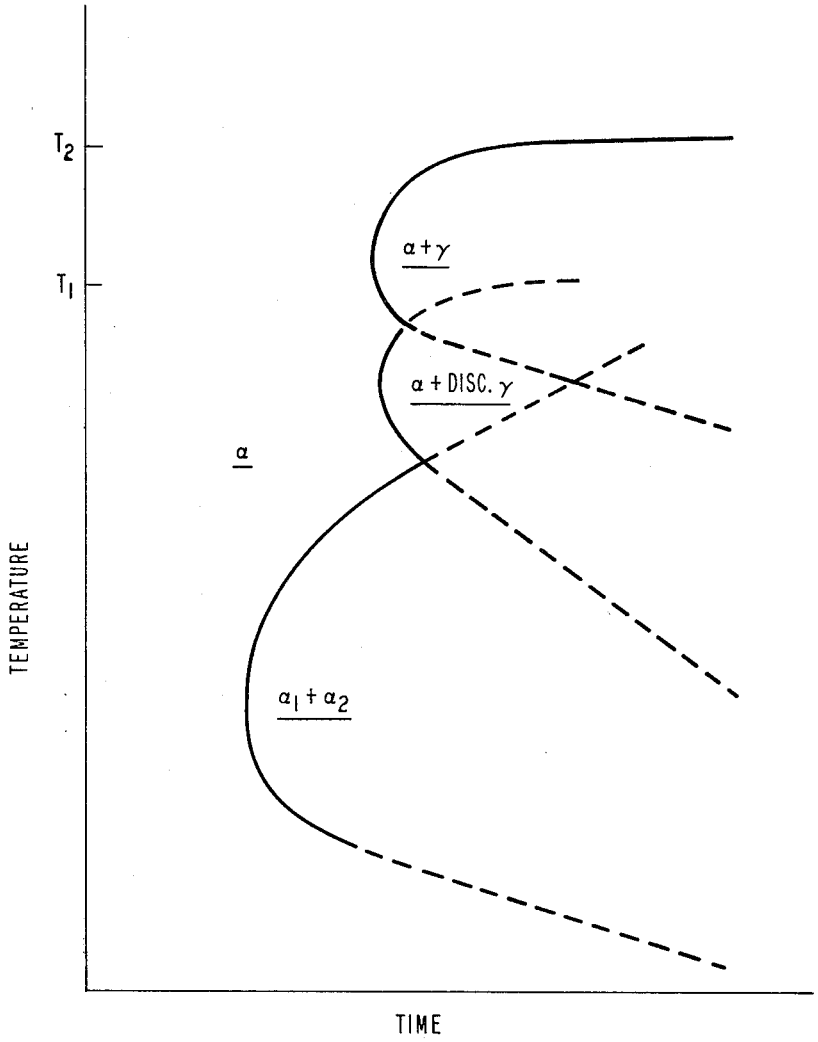
FIG. 5 is a schematic time-temperature-transformation diagram as may be determined for alloys of the invention by standard metalurgical analytical techniques.

Time-temperature-transformation diagram shown in FIG. 5 is considered typical for alloys of the invention, temperature $T_2$ corresponding to the boundary between a single and a two-phase region, and temperature $T_1$ to the boundary between lamellar and nonlamellar gamma two-phase regions. Preferred temperatures for heating to develop alpha plus essentially nonlamellar gamma structure according to the invention lies in the interval from $T_1$ to $T_2$.

EXAMPLE 1

A sample of an alloy comprising 15 weight percent Ni, 8 weight percent Sn, and remainder essentially Cu was cold worked, heated to, and maintained at a temperature of 725 degrees Celsius for 4 hours, and water quenched to room temperature. At this point the alloy had essentially uniform grain size of approximately 3 micrometers. The alloy was reheated to and maintained at a temperature of 425 degrees Celsius for times shown in FIG. 1 and FIG. 2, and air cooled. Properties of 0.01 percent offset yield strength and ductility are graphically depicted by curves labelled "A" in FIGS. 1 and 2.

EXAMPLE 2

A sample of an alloy comprising 15 weight percent Ni, 8 weight percent Sn, 0.3 weight percent Nb, and remainder essentially Cu was treated according to the schedule described above in connection with Example 1. Properties of percent elongation to failure and 0.01 percent offset yield strength are shown in FIGS. 3 and 4, respectively.

What is claimed is:

1. Method for producing an article of manufacture comprising a body of an alloy which is susceptible to spinodal decomposition, said alloy comprising an amount of at least 80 weight percent Cu, Ni, and Sn, said alloy comprising Ni in a percentage by weight which here is designated as n and which is in a range of from 3 to 15 weight percent of said alloy, said alloy comprising Sn in a percentage by weight which here is designated as s and which is in a range of 3.5–15 weight percent of said alloy, said method comprising heat treating said body, rapidly cooling, and aging, said method being characterized in that heat treating is at a temperature which corresponds to a multiphase state of said alloy, which is greater than or equal to 5 times n plus 550 degrees Celsius, which is less than or equal to 5 times n plus 725 degrees Celsius, which is less than 17 times the sum of n and s plus 465 degrees Celsius, and which is less than or equal to 725 degrees Celsius, whereby an amount of at least 0.1 weight percent of said alloy is nonlamellar gamma phase prior to cooling.

2. Method of claim 1 in which heat treating is at a temperature which is less than or equal to 17 times the sum of n and s plus 460 degrees Celsius.

3. Method of claim 1 in which cooling is to a temperature which corresponds to an alpha phase or an alpha-1 plus alpha-2 phase in the time-temperature-transformation diagram of said alloy.

4. Method of claim 3 in which cooling is to a temperature which is less than 500 degrees Celsius.

5. Method of claim 4 in which cooling is to a temperature which is less than or equal to room temperature.

6. Method of claim 1 in which cooling is at a rate sufficient to ensure retention of at least 90 percent of nonlamellar gamma phase produced by heat treating.

7. Method of claim 6 in which at least 99 percent of nonlamellar gamma phase is retained.

8. Method of claim 1 in which said alloy has a grain size which is less than or equal to 20 micrometers.

9. Method of claim 8 in which said grain size is less than or equal to 5 micrometers.

10. Method of claim 1 in which said alloy comprises not more than 1 weight percent Nb, not more than 1 weight percent Mo, not more than 1 weight percent Ta, and not more than 1 weight percent V, combined amounts of Nb, Mo, Ta, and V being not more than 2 weight percent.

11. Method of claim 1 in which said alloy comprises not more than 15 weight percent Fe, not more than 10 weight percent Zn, and not more than 15 weight percent Mn.

12. Method of claim 1 in which said alloy comprises not more than 2 weight percent MnS, not more than 0.5 weight percent Se, not more than 0.5 weight percent Te, and not more than 0.2 weight percent Pb.

13. Method of claim 1 in which said alloy comprises not more than 0.2 weight percent Zr, not more than 1 weight percent Cr, not more than 1.5 weight percent Al, and not more than 1 weight percent Mg.

14. Method of claim 1 in which said alloy consists essentially of Cu, Ni, and Sn.

15. Method of claim 1 in which said article is shaped as cast, as hot worked, or as warm worked.

16. Method of clam 1 in which said body, prior to heat treating at a temperature corresponding to a multiphase state of said alloy, is subjected to steps of heat treating in an essentially single phase state, rapid cooling, and cold working.

* * * * *